US007740328B2

(12) United States Patent
Huang et al.

(10) Patent No.: US 7,740,328 B2
(45) Date of Patent: Jun. 22, 2010

(54) BALL BEARING SLIDE ASSEMBLY

(75) Inventors: Kuo-Ming Huang, Taipei Hsien (TW); Mo-Ming Yu, Shenzhen (CN); Zong-Yuan Li, Shenzhen (CN); Song Wang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 266 days.

(21) Appl. No.: 11/923,659

(22) Filed: Oct. 25, 2007

(65) Prior Publication Data

US 2008/0159670 A1 Jul. 3, 2008

(30) Foreign Application Priority Data

Dec. 29, 2006 (CN) ..... 2006 1 0201477

(51) Int. Cl.
*A47B 95/00* (2006.01)

(52) U.S. Cl. ..... 312/333

(58) Field of Classification Search ..... 312/333, 312/334.44–334.47, 334.7, 334.8; 384/21
See application file for complete search history.

(56) References Cited

U.S. PATENT DOCUMENTS

| | | | | |
|---|---|---|---|---|
| 5,248,195 | A * | 9/1993 | Shin | 312/334.33 |
| 6,585,335 | B2 * | 7/2003 | Hwang et al. | 312/333 |
| 6,764,151 | B2 * | 7/2004 | Huang | 312/334.46 |
| 6,824,233 | B2 * | 11/2004 | Chen et al. | 312/334.46 |
| 6,860,574 | B2 * | 3/2005 | Hwang et al. | 312/334.44 |
| 6,945,619 | B1 * | 9/2005 | Chen et al. | 312/334.47 |
| 6,997,611 | B2 * | 2/2006 | Chen et al. | 384/21 |
| 7,101,081 | B2 * | 9/2006 | Chen et al. | 384/21 |
| 7,441,848 | B2 * | 10/2008 | Chen et al. | 312/333 |
| 2007/0170830 | A1 * | 7/2007 | Huang | 312/334.47 |

* cited by examiner

*Primary Examiner*—Janet M Wilkens
*Assistant Examiner*—Dan Rohrhoff
(74) *Attorney, Agent, or Firm*—Frank R. Niranjan

(57) ABSTRACT

A ball bearing slide assembly includes a first slide, a second slide slidably receiving the first slide, a slide-aiding member, and a positioning member slidably attached to the second slide. The slide-aiding member is slidably sandwiched between the first slide and the second slide. The slide-aiding member includes two arms each having a plurality of ball bearings installed therein for facilitating the sliding movement of the first slide relative to the second slide. The slide-aiding member defines a latching slot therein. The positioning member includes a positioning portion engagable in the latching slot of the slide-aiding member for fixing the slide-aiding member to the second slide.

17 Claims, 6 Drawing Sheets

BALL BEARING SLIDE ASSEMBLY

BACKGROUND

1. Field of the Invention

The present invention relates to ball bearing slide assemblies, and particularly to a ball bearing slide assembly having a positioning device for positioning a slide-aiding member thereof.

2. Description of Related Art

A slide assembly is usually used to connect two articles that may be moved relative to each other, such as a cabinet and a server or a cupboard and a drawer. A conventional three-section slide assembly generally includes an outer slide, an intermediate slide, and an inner slide. For example, the outer slide may be fixed in a cabinet, the inner slide may be fixed at a side of the drawer of the cabinet, and the intermediate slide is received in the outer slide to support the inner slide. The inner slide, the intermediate slide, and the outer slide may be coupled with each other in that sequence, and the inner slide and the intermediate slide may be moved along a longitudinal axial direction of the outer slide. One or more slide-aiding members, each including ball bearings, may be assembled between each two slides, for facilitating the sliding movement of the slides relative to each other. The slide-aiding members can slide between the corresponding slides. However, it is difficult to insert the inner slide into an unfixed slide-aiding member because the slide-aiding member may be pushed to slide along the intermediate slide by an end of the inner slide.

What is desired, therefore, is a slide assembly having a positioning device for its slide-aiding member for facilitating assembling the slide assembly.

SUMMARY

An exemplary ball bearing slide assembly includes a first slide, a second slide slidably receiving the first slide, a slide-aiding member, and a positioning member slidably attached to the second slide. The slide-aiding member is slidably sandwiched between the first slide and the second slide. The slide-aiding member includes two arms each having a plurality of ball bearings installed therein for facilitating the sliding movement of the first slide relative to the second slide. The slide-aiding member defines a latching slot therein. The positioning member includes a positioning portion engagable in the latching slot of the slide-aiding member for fixing the slide-aiding member to the second slide.

Other advantages and novel features of the present invention will become more apparent from the following detailed description of an embodiment when taken in conjunction with the accompanying drawings, in which:

DETAILED DESCRIPTION

Figure 1:
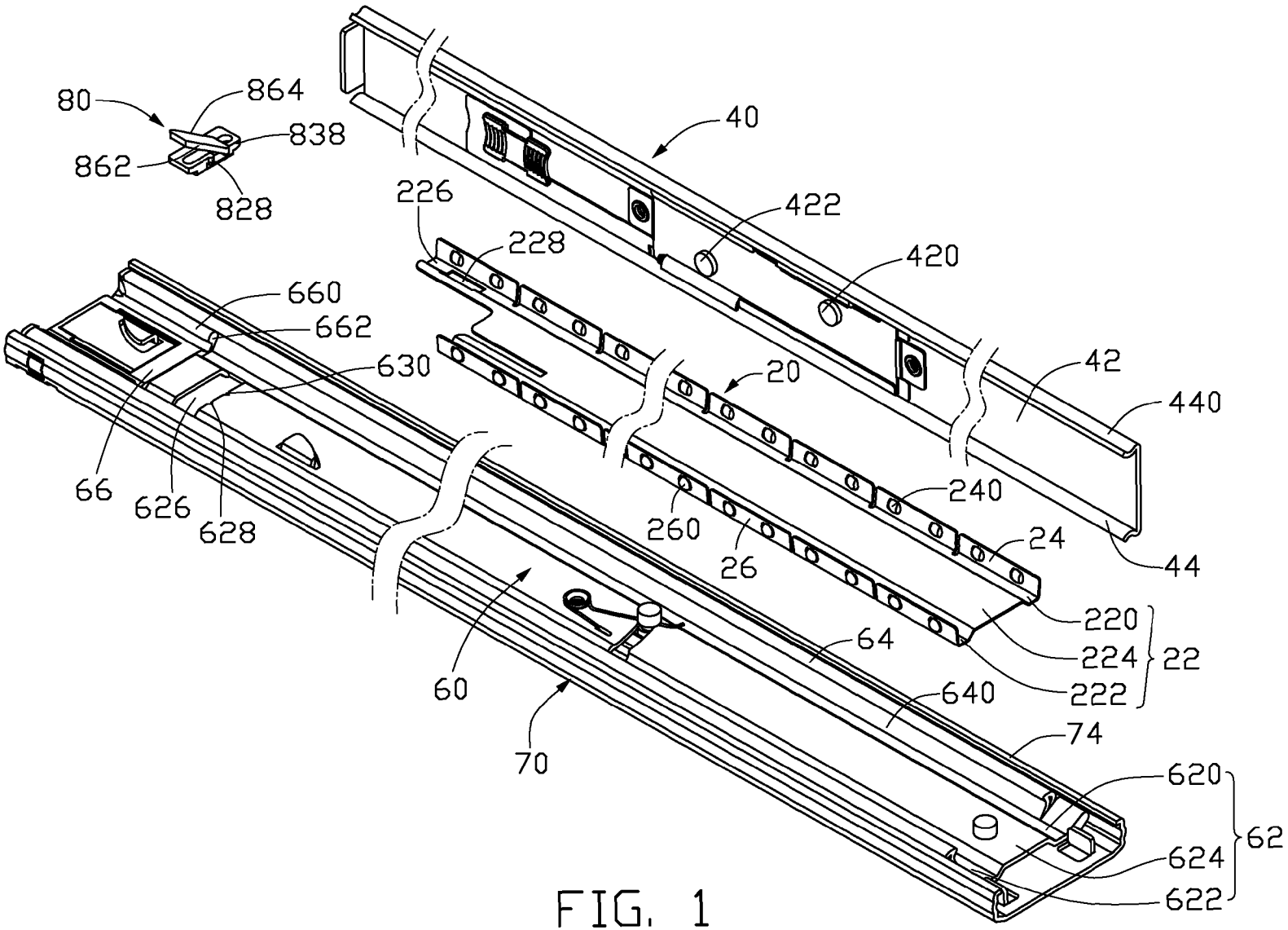
FIG. 1 is an exploded, isometric view of a ball bearing slide assembly in accordance with an embodiment of the present invention, the slide assembly including a slide-aiding member, a positioning member, and a first slide.
Figure 2:
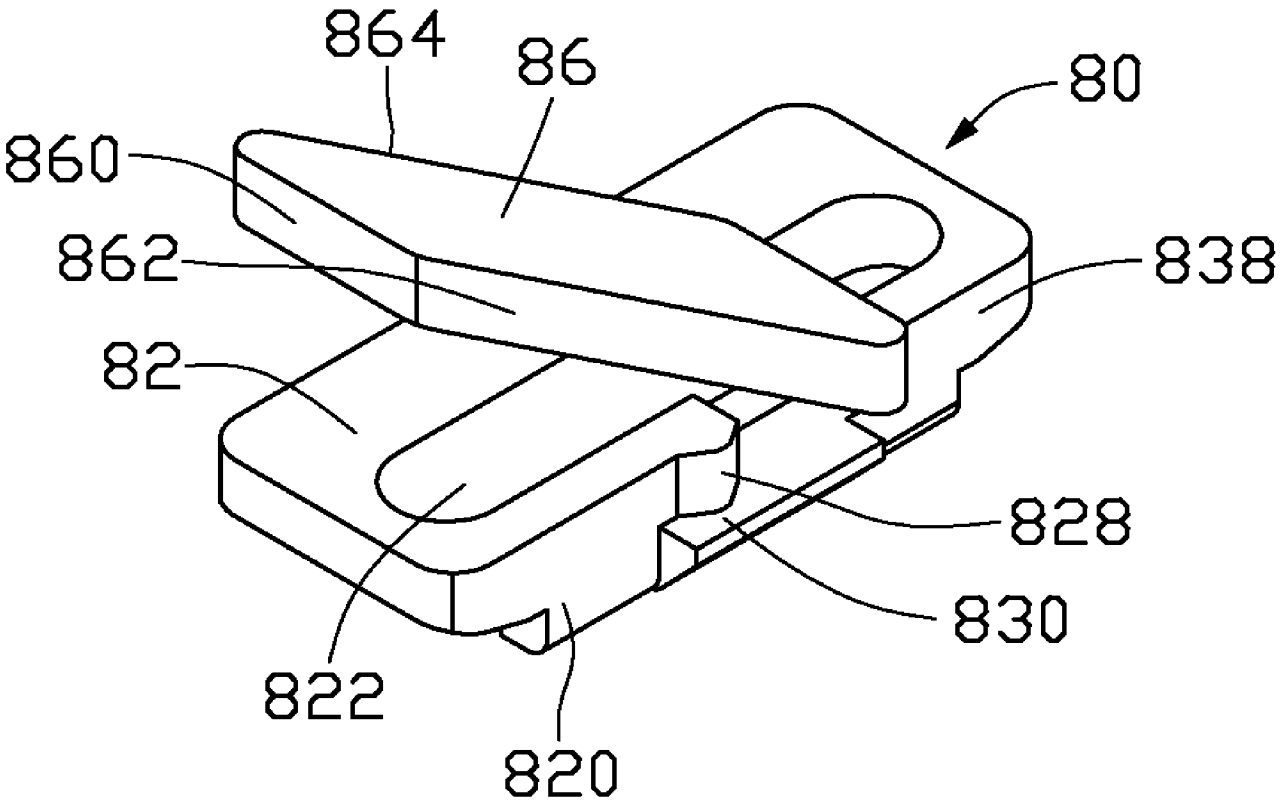
FIG. 2 is an enlarged view of the positioning member of FIG. 1.
Figure 3:
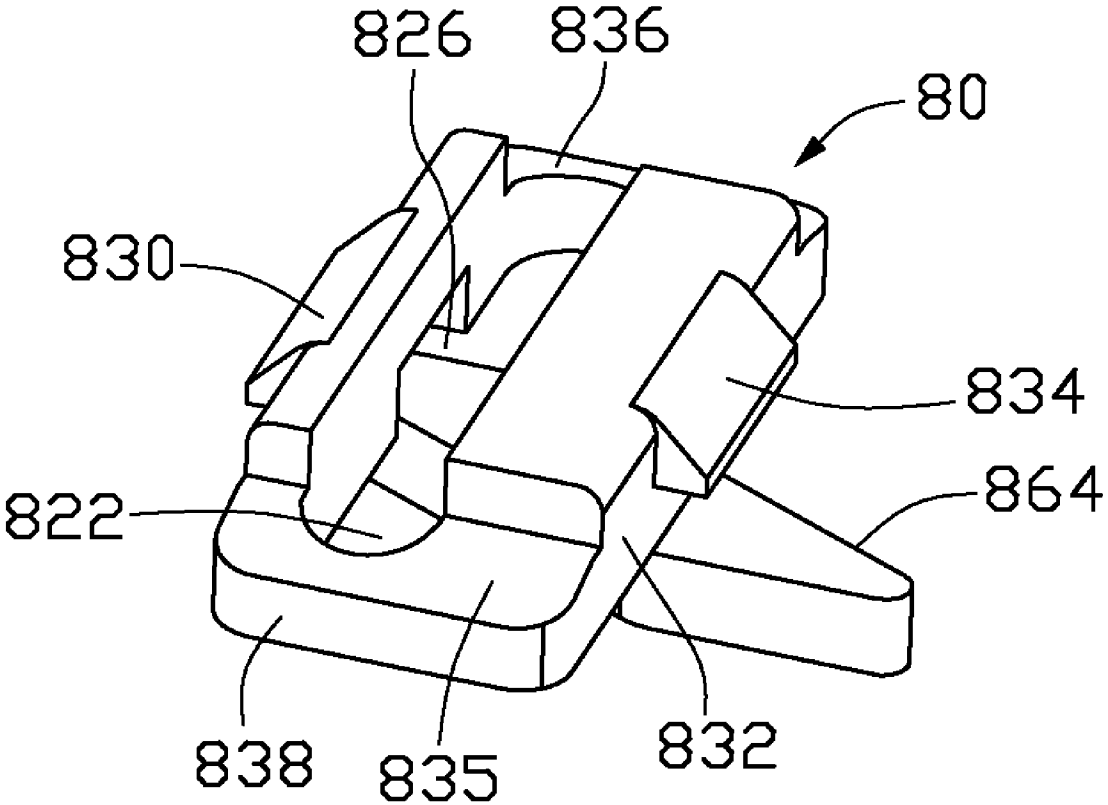
FIG. 3 is an enlarged view of the positioning member of FIG. 1, but viewed from another aspect.

Referring to FIGS. 1 to 3, a ball bearing slide assembly in accordance with an embodiment of the present invention is shown. The ball bearing slide assembly includes a slide-aiding member 20, a first slide 40, a second slide 60 for receiving the slide-aiding member 20 and the first slide 40, a third slide 70 for receiving the second slide 60, and a positioning member 80 for positioning the slide-aiding member 20 relative to the second slide 60.

The positioning member 80 is made of plastic or other elastic material, and includes a base 82, and an abutting portion 86. The base 82 has the approximate shape of a rectangular parallelepiped, and includes two opposite sidewalls 820, 832. A through slot 822 is defined in the base 82, adjacent the sidewall 820 of the base. A recess 826 is defined in the sidewall 820 and in communication with the through slot 822. A block 828 having an arcuate surface is formed on the sidewall 820, adjacent an end of the recess 826. A protrusion 830 is formed on the sidewall 820. The protrusion 830 includes an upper plane flush with a bottom of the recess 826, and an inclined plane extending from the upper plane to a bottom surface of the base 82. A protrusion 834 symmetrical to the protrusion 830 is formed on the sidewall 832. The protrusion 834 also includes an upper plane and an inclined plane. Two cutouts 835, 836 are defined in the base 82, respectively at two ends of the bottom surface. A positioning portion 838 is formed on an end of the base 82, adjacent the cutout 835. The abutting portion 86 is a parallelogram block, and slantingly formed on an upper surface of the base 82. The abutting portion 86 includes two end walls 860 parallel to end walls of the base 82, a slanted locking wall 862, and a slanted unlocking wall 864 parallel to the locking wall 862.

The slide-aiding member 20 is sandwiched between the first slide 40 and the second slide 60. The slide-aiding member 20 has a substantially U-shaped cross-section, and includes a web 22, and two arms 24, 26 respectively extending from two lateral edges of the web 22. The web 22 includes a longitudinal base plate 224 with two lower troughs 220, 222 located at opposite sides thereof and adjoining the arms 24, 26 respectively. A latching portion 226 extends from an end of the trough 220, and the arm 24 adjoining the trough 220 is longer than the arm 26. The latching portion 226 defines a latching slot 228 therein for receiving the positioning portion 838 of the positioning member 80. A plurality of ball bearings 240, 260 is installed in the arms 24, 26 respectively.

The first slide 40 has a substantially inverted U-shaped cross-section, and includes a web 42, and two arms 44 extending from two lateral edges of the web 42 respectively. A locking post 420 and an unlocking post 422 are formed offset from each other on a bottom surface of the web 42. The arms 44 are recessed toward each other, thereby a slide channel 440 is formed on an outer surface of each arm 44 along the longitudinal direction.

The second slide 60 has a substantially U-shaped cross-section, and includes a web 62, and two arms 64 respectively extending from two lateral edges of the web 62. Each arm 64 defines an inner channel 640 in an inner surface thereof. The web 62 includes a longitudinal base plate 624 with two lower troughs 620, 622 located at opposite sides thereof and adjoining the arms 64 respectively. An opening 626 communicating with the troughs 620, 622 is defined in the base plate 624 adjacent to a first end of the second slide 60. Two engaging slots 628, 630 are defined in a portion of the base plate 624 bounding the opening 626. A stop portion 66 is formed on the second slide 60 between the opening 626 and the first end of the second slide 60. The stop portion 66 includes two arms 660 received in the inner channels 640 of the arms 64 of the second slide 60 respectively. Each arm 660 of the stop portion 66 forms a stop surface 662 toward a second end of the second slide 60 opposite to the first end.

The third slide 70 has a substantially U-shaped cross-section, and includes a web, and two arms 74 respectively extending from two lateral edges of the web. The web and the arms 74 cooperatively define a receiving space, and the second slide 60 is slidably received in the receiving space. Two or more slide channels are defined between the third slide 70 and the second slide 60, for facilitating the sliding movement of the second slide 60 relative to the third slide 70. Furthermore, a slide-aiding member can be added between the slide channels of the second slide 60 and the third slide 70.

Figure 4:
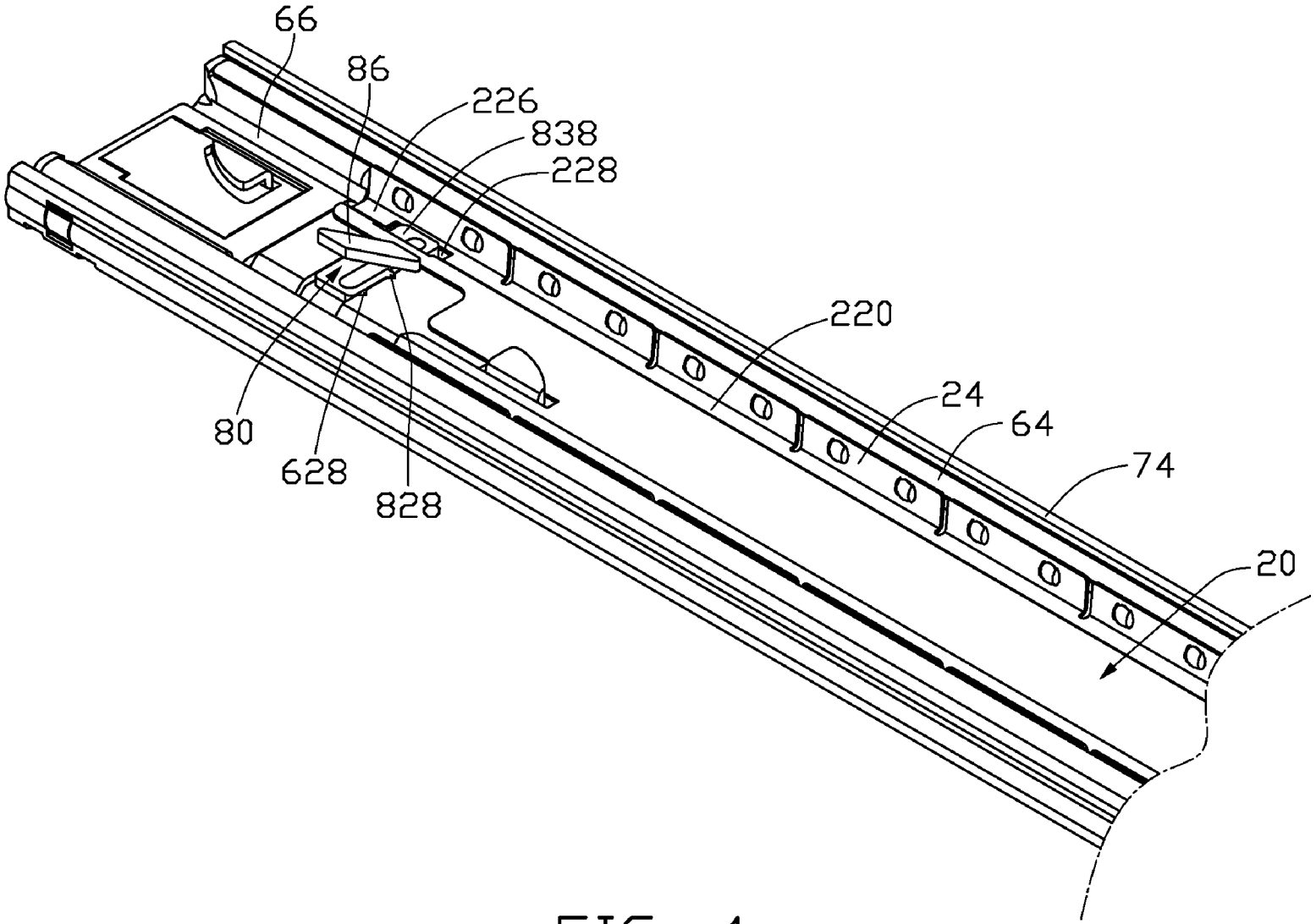
FIG. 4 is an assembled view of an end of the ball bearing slide assembly in accordance with an embodiment of the present invention, but the first slide is not shown.

Referring further to FIG. 4, in assembly, the positioning member 80 is pressed to be inserted into the opening 626 of the base plate 624 of the second slide 60, with the base 82 of the positioning member 80 being deformed toward the through slot 822 to allow the protrusions 830, 834 to be inserted into the opening 626, and a bottom surface of the abutting portion 86 of the positioning member 80 abutting against a top surface of the base plate 624 of the second slide 60. Thereafter, the base 82 is released and rebounds to make the upper planes of the protrusions 830, 834 of the abutting portion 86 abut against a bottom surface of the base plate 624. Thereby, the positioning member 80 is received in the opening 626 of the base plate 624 of the second slide 60 and slidable in a cross direction perpendicular to the longitudinal direction of the second slide 60.

The positioning member 80 is pushed to make the block 828 engage in the engaging slot 628 of the base plate 624 of the second slide 60. The slide aiding member 20 is pushed to inserted into the second slide 60 from the second end thereof, the ball bearings 240, 260 of the slide-aiding member 20 are received in and slide in the longitudinal direction along the inner channels 640 of the arms 64 of the second slide 60, until a free end of the latching portion 226 of the slide aiding member 20 abuts against the stop surface 662 of the stop portion 66 of the second slide 60. The latching slot 228 of the slide aiding member 20 aligns with the opening 626 of the second slide 60. The abutting portion 86 of the positioning member 80 is pushed toward the latching portion 226 of the slide aiding member 20, the block 828 of the positioning member 80 disengages from the engaging slot 628 of second slide 60 and then engages in the engaging slot 630. The positioning portion 838 of positioning member 80 engages in the latching slot 228 of the latching portion 226. Thereby the slide aiding member 20 is locked to the second slide 60.

Figure 5:
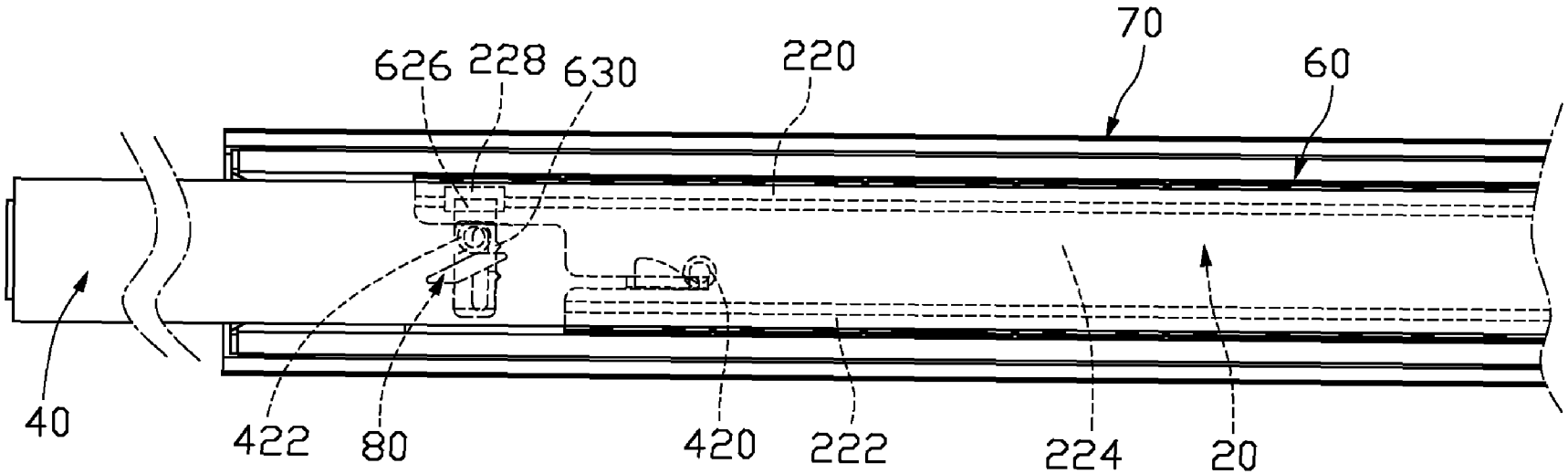
FIG. 5 is an assembled view of FIG. 1, showing the slide-aiding member in an unlocked position.

Referring also to FIG. 5, to assemble the first slide 40 into the second slide 60, the first slide 40 is inserted into the stop portion 66 of the second slide 60 from the first end of the second slide 60, with the bottom surface of the first slide 40 facing the second slide 60. The first slide 40 slides along the arms 660 of the stop portion 66 in the longitudinal direction and then slides into the slide aiding member 20. The slide channels 440 of the first slide 40 contact with the ball bearings 240, 260 of the slide aiding member 20 respectively. The first slide 40 slides in the second slide 60 fluidly with the aid of the ball bearings 240, 260. When the unlocking post 422 of the first slide 40 abuts against the unlocking wall 864 of the abutting portion 86 of the positioning member 80, the first slide 40 is further pushed to make the unlocking post 422 push the positioning member 80 to slide away from the latching portion 226 of the slide aiding member 20. The block 828 of the positioning member 80 disengages from the engaging slot 630 and then engages in the engaging slot 628, with the positioning portion 838 disengaging from the latching slot 228 of the latching portion 226 of the slide aiding member 20. Thereby the slide aiding member 20 is unlocked from the second slide 60. The unlocking post 422 passes through a space between the abutting portion 86 of the positioning member 80 and the latching portion 226, thereafter the slide aiding member 20 slides together with the first slide 40 toward the second end of the second slide 60.

Figure 6:
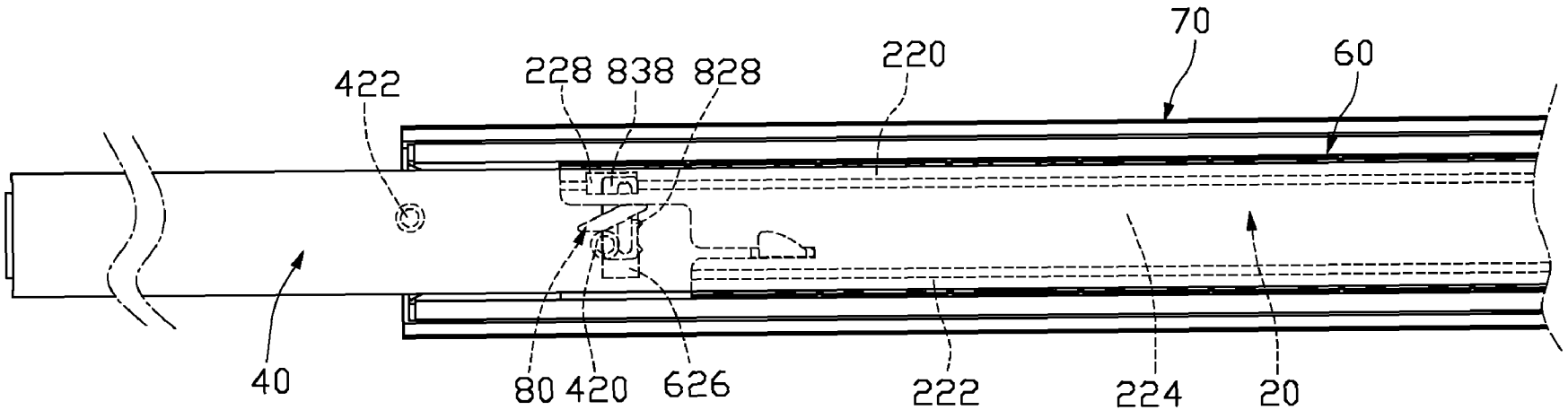
FIG. 6 is similar to FIG. 5, but showing the slide-aiding member in a locked position.

Referring also to FIG. 6, to draw out the first slide 40 from the second slide 60, the first slide 40 is pulled to slide together with the slide aiding member 20 toward the first end of the second slide 60. When the free end of the latching portion 226 of the slide aiding member 20 abuts against the stop surface 662 of the second slide 60, the slide aiding member 20 is stopped. The first slide 40 is further pulled to slide, and when the locking post 420 abuts against the locking wall 862 of the positioning member 80, the positioning member 80 is pushed toward the latching portion 226 of the slide aiding member 20 by the locking post 420 of the first slide 40. The block 828 of the positioning member 80 disengages from the engaging slot 628 and then engages in the engaging slot 630. The positioning portion 838 engages in the latching slot 228 of the latching portion 226 and locks the slide aiding member 20 to the second slide 60. The locking post 420 passes through a space between the abutting portion 86 of the positioning member 80 and the trough 622 of the second slide 60 opposite to the latching portion 226 of the slide aiding member 20. Thereafter, the first slide 40 is ready to be pulled out.

It is believed that the present embodiment and its advantages will be understood from the foregoing description, and it will be apparent that various changes may be made thereto without departing from the spirit and scope of the invention or sacrificing all of its material advantages, the example hereinbefore described merely being preferred or exemplary embodiment of the invention.

What is claimed is:

1. A ball bearing slide assembly, comprising:

a first slide;

a second slide slidably receiving the first slide;

a slide-aiding member slidably sandwiched between the first slide and the second slide, the slide-aiding member comprising two arms each having a plurality of ball bearings installed therein facilitating the sliding movement of the first slide relative to the second slide, the slide-aiding member defining a latching slot therein; and a positioning member slidably attached to the second slide, the positioning member comprising a positioning portion engagable in the latching slot of the slide-aiding member, wherein when the first slide is slid into the second slide, the positioning member is driven by the first slide to be disengaged from the latching slot of the slide-aiding member, the slide-aiding member slides together with the first slide; when the first slide is drawn out from the second slide, the position member is driven by the first slide to be engaged in the latching slot of the slide-aiding member, the slide-aiding member is fixed to the second slide.

2. The ball bearing slide assembly as described in claim 1, wherein the positioning member comprises a base, and an abutting portion slantingly formed on the base, the abutting portion comprises a locking wall, the first slide forms a locking post on a bottom surface thereof, the locking post abuts against the locking wall of the positioning member and pushes the positioning member to slide until the positioning portion engages in the latching slot of the slide-aiding member when the first slide is drawn out from the second slide.

3. The ball bearing slide assembly as described in claim 2, wherein the abutting portion of the positioning member forms an unlocking wall, the first slide further forms an unlocking post on the bottom surface thereof the unlocking post abuts against the unlocking wall of the positioning member and pushes the positioning member to slide until the positioning portion disengages from the latching slot of the slide-aiding member when the first slide is slid into the second slide.

4. The ball bearing slide assembly as described in claim 3, wherein the locking wall and the unlocking wall are slanted and parallel to each other, the locking post and the unlocking post are offset from each other.

5. The ball bearing slide assembly as described in claim 2, wherein the second slide defines an opening therein, the base of the positioning member comprises two protrusions extending from two opposite sidewalls thereof, the base is slidably received in the opening, and a portion of the second slide bounding the opening is sandwiched between the protrusions and the abutting portion of the positioning member.

6. The ball bearing slide assembly as described in claim 5, wherein a block having an arcuate surface is formed on a sidewall of the base, the portion of the second slide bounding the opening defines two spaced engaging slots for receiving the block and locking the positioning member in two different positions relative to the second slide.

7. The ball bearing slide assembly as described in claim 5, wherein the positioning member is made of plastic material, the base defines a through slot between the protrusions for facilitating deformation of the base in order to enter the opening of the second slide, each of the protrusions includes a planar upper plane, and an inclined bottom plane.

8. The ball bearing slide assembly as described in claim 1, wherein the first slide comprises a web and two arms extending downwardly from two lateral edges of the web respectively, each of the arms forms a slide channel on an outer surface thereof; the second slide comprises two arms each forming an inner channel; the ball bearings of the slide-aiding member contact with the slide channels of the first slide and the inner channels of the second slide respectively so as to facilitate the first slide to slide in the second slide.

9. The ball bearing slide assembly as described in claim 1, wherein the slide-aiding member comprises a web, and two arms respectively extending from two lateral edges of the web, the web comprises a base plate with two lower troughs located at two opposite sides thereof, a latching portion extends from one of the troughs, the latching slot is defined in the latching portion.

10. The ball bearing slide assembly as described in claim 9, wherein a stop portion is formed on the second slide adjacent to one end thereof, the stop portion comprises a stop surface back to the first end for abutting against the latching portion of the slide-aiding member.

11. The ball bearing slide assembly as described in claim 1, further comprising a third slide, the third slide comprising a web, and two arms respectively extending from two lateral edges of the web for receiving the second slide.

12. A slide assembly, comprising:

a first slide forming two offset posts;

a second slide slidably receiving the first slide in a longitudinal direction;

a slide-aiding member slidably sandwiched between the first slide and the second slide and facilitating the slide movement of the first slide relative to the second slide in the longitudinal direction, the slide-aiding member defining a latching slot therein; and a positioning member attached to the second slide, the positioning member comprising a positioning portion pushed by the posts of the first slide to slide in a cross direction perpendicular to the longitudinal direction to engage in the latching slot of the slide-aiding member in response to the first slide being drawn out from the second slide, or disengage from the latching slot of the slide-aiding member in response to the first slide being slid into the second slide, thereby to lock the slide-aiding member to the second slide or unlocking the slide-aiding member from the second slide.

13. The slide assembly as described in claim 12, wherein the second slide defines an opening in the cross direction, the positioning member comprises a base slidably received in the opening.

14. The slide assembly as described in claim 13, wherein the positioning member further comprises an abutting portion slantingly extending from the base, the abutting portion forms a locking wall, one of the posts of the first slide abuts against the locking wall of the positioning member and pushes the positioning member to slide and engage in the latching slot of the slide-aiding member in response to the first slide being drawn out from the second slide.

15. The slide assembly as described in claim 14, wherein the abutting portion of the positioning member further forms an unlocking wall, the other one of the posts of the first slide abuts against the unlocking wall of the positioning member and pushes the positioning member to slide and disengage from the latching slot of the slide-aiding member in response to the first slide being slid into the second slide.

16. The slide assembly as described in claim 12, wherein the slide-aiding member comprises two arms each having a plurality of ball bearings installed therein, the ball bearings contact with the first slide and the second slide respectively so as to facilitate the first slide to slide in the second slide.

17. A ball bearing slide assembly, comprising:

a first slide forming two posts offset from each other both in the longitudinal direction and the cross direction;

a second slide slidably receiving the first slide in the longitudinal direction;

a slide-aiding member slidably sandwiched between the first slide and the second slide, the slide-aiding member comprising two arms each having a plurality of ball bearings installed therein and facilitating the sliding movement of the first slide relative to the second slide, a latching slot is defined in the slide-aiding member; and a positioning member slidably attached to the second slide, the positioning member comprising a positioning portion and an abutting portion, two slanting surfaces are formed on opposite sides of the abutting portion corresponding to the posts of the first slide, wherein when the first slide is drawn out from the second slide, one of the posts pushes a corresponding slanting surface of the positioning member and drives the positioning portion to slide in the cross direction to engage in the latching slot of the slide-aiding member and fix the slide-aiding member to the second slide; when the first slide is slid into the second slide, the other one of the posts pushes the other slanting surface of the positioning member and drives the positioning portion to slide in the cross direction to disengage from the latching slit of the slide-aiding member.

* * * * *